US006844874B2

(12) United States Patent
Maurice

(10) Patent No.: US 6,844,874 B2
(45) **Date of Patent: *Jan. 18, 2005**

(54) DEVICE FOR CONTROLLING A MATRIX DISPLAY CELL

(76) Inventor: François Maurice, 39 avenue Rhin et Danube, F-38100 Grenoble (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,146

(22) PCT Filed: Oct. 19, 1998

(86) PCT No.: PCT/FR98/02236

§ 371 (c)(1),
(2), (4) Date: Aug. 6, 1999

(87) PCT Pub. No.: WO99/31650

PCT Pub. Date: Jun. 24, 1999

(65) Prior Publication Data

US 2002/0130827 A1 Sep. 19, 2002

(30) Foreign Application Priority Data

Dec. 15, 1997 (FR) ..... 97 15863

(51) Int. Cl.[7] ..... G09G 5/00; G09G 3/30; G09G 3/36

(52) U.S. Cl. ..... 345/208; 345/76; 345/94

(58) Field of Search ..... 345/55, 76, 87, 345/90, 92, 94, 98, 99, 100, 58, 77, 78, 79, 95, 96, 208–210; 315/169.3; 349/42

(56) References Cited

U.S. PATENT DOCUMENTS 4,546,289 A * 10/1985 Delgrange ..... 315/169.4
5,122,676 A * 6/1992 Stewart et al. ..... 327/172
5,349,366 A * 9/1994 Yamazaki et al. ..... 345/92
5,434,899 A * 7/1995 Huq et al. ..... 377/78
5,654,811 A 8/1997 Spitzer et al. ..... 349/106
5,670,792 A * 9/1997 Utsugi et al. ..... 257/59
5,684,365 A * 11/1997 Tang et al. ..... 315/169.3
5,701,136 A * 12/1997 Huq et al. ..... 345/100
5,786,796 A * 7/1998 Takayama et al. ..... 345/76
5,949,398 A * 9/1999 Kim ..... 345/100
6,052,426 A * 4/2000 Maurice ..... 377/78
6,064,713 A * 5/2000 Lebrun et al. ..... 377/67
6,100,860 A * 8/2000 Takayama et al. ..... 345/76
6,175,345 B1 * 1/2001 Kuribayashi et al. ..... 345/76
6,225,750 B1 * 5/2001 Kimura ..... 315/169.3

FOREIGN PATENT DOCUMENTS

EP 0506027 9/1992 ..... G09G/3/36
EP 0750288 12/1996 ..... G09G/3/36

* cited by examiner

*Primary Examiner*—Bipin Shalwala
*Assistant Examiner*—Jeff Piziali
(74) *Attorney, Agent, or Firm*—Joseph S. Tripoli; Harvey D. Fried; Sammy S. Henig

(57) ABSTRACT

The present invention relates to a matrix control device including a set of control circuits arranged in lines and columns and controlling an elementary point, the state of each elementary point being a function of first and second control signals) applied to the control circuit respectively by the lines and columns. The control circuit consists of a first transistor connecting the elementary point to the corresponding line receiving the first signal and a second transistor a first electrode of which is connected to the gate of the first transistor, the gate of which is linked to the corresponding column receiving the second signal and the second electrode of which is connected to a reference potential.

12 Claims, 2 Drawing Sheets

DEVICE FOR CONTROLLING A MATRIX DISPLAY CELL

The present invention relates to a matrix control device, more especially a matrix control device used in a flat screen such as a liquid crystal screen of the active matrix type or other types of flat screen.

Figure 1:
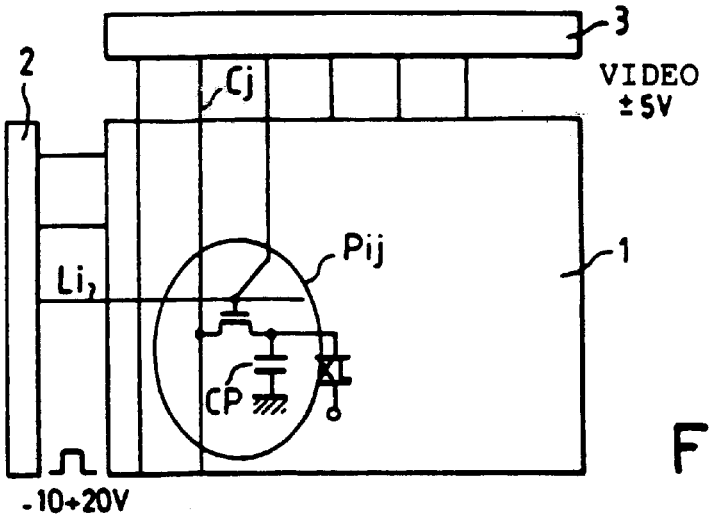
FIG.1 PRIOR ART

In the prior art, a matrix control device is used, for example, to control the cells of a flat screen, such as liquid crystal cells. In this case, a liquid crystal display of the active matrix type is involved, known also by the abbreviation AM-LCD. Such a liquid crystal screen of the active matrix type is represented in FIG. 1. In this case, the screen consists of a certain number of electro-optical cells, each formed by an electrode and a counter-electrode enclosing the liquid crystal. These cells are referenced XL on the said Figure. The electro-optical cells are arranged in lines and columns, and each is controlled by a switching circuit forming part of a matrix-type control device. As represented in FIG. 1, the switching circuit is formed by a transistor T, one of the electrodes of which is connected to a column Cj, and the other electrode of which is connected to the electro-optical cell XL. Moreover, the gate of the transistor T is connected to one of the lines Li of the control device. In most cases, the electro-optical cell XL is associated with a storage capacitor CP mounted in parallel with the capacitor formed by the electro-optical cell at the output of the transistor T. The assembly formed by the transistor T and the capacitor CP forms an elementary control circuit referenced Pij in FIG. 1. Moreover, each of the selection lines Li is connected to a control circuit 2 or "line driver" which applies a control pulse having a voltage typically varying between −10 and +20 volts, to each line in succession. Likewise, each of the columns Cj or data lines is connected to a column control circuit 3 or "column driver" which sends out, onto the columns Cj, an analogue signal corresponding to a video signal more particularly representing a grey scale, the voltage of which typically varies between + and −5 volts.

With this matrix control device, an electro-optical cell XL is controlled in the following way. When a pulse is applied to a selection line Li, the switching transistor T is turned on. That being so, the analogue voltage applied to the column Cj is sent to the terminals of the electrodes of the electro-optical cell XL which displays a level of grey corresponding to the data signal.

In general, a matrix control device of this type has switching transistors, which in most cases are of the TFT type, TFT standing for "Thin Film Transistor". Such a device is generally produced from amorphous silicon. Moreover, the line and column control circuits 2, 3, can be integrated on the substrate plate on which the flat screen is produced, or be produced independently. When they are integrated on the substrate plate, they are also made using amorphous silicon.

One of the problems encountered with this type of matrix control device is a consumption problem, due particularly to the amplitude of the signals applied on the lines and the columns. This problem is all the greater when the technique known as "line inversion" is used for addressing the lines of the matrix screen, the polarity inversion taking place at each line. In this case, a consumption amounting to one watt can be obtained for a line frequency of 30 kHz.

Another problem encountered with this structure, when it is produced with transistors of polycrystalline silicon or monocrystalline silicon, relates to the leakage current of the switching transistor T in the off state which tends to discharge the elementary points or electro-optical cells XL.

The object of the present invention is to remedy the abovementioned drawbacks by proposing a matrix control device exhibiting a novel structure for the elementary control circuit of each elementary point, this structure being particularly well suited to the use of polycrystalline or monocrystalline silicon for the production of the transistors or other semiconductor circuits.

Hence the object of the present invention is a matrix control device including a set of control circuits arranged in lines and columns and controlling an elementary point, the state of each elementary point being a function of first and second control signals applied to the control circuit respectively via the lines and columns, characterized in that each control circuit is an electrical circuit the impedance of which between its output and that of its inputs which is carrying the first signal becomes low following the application of an adequate voltage pulse on this first signal, and in that this same impedance becomes very high following the application of an adequate voltage on the second signal.

In this case, the first signal is a signal which, in a first stage, makes it possible to activate all the control circuits of the corresponding line by turning them on, then to apply a voltage ramp which is sent as the output of the control circuit to the corresponding elementary point. According to one preferred embodiment, the first signal consists of a ramp-shaped signal preceded by a negative pre-charge pulse. According to one improvement, the instant of triggering of the ramp-shaped signal is preferably adjusted from line to line so as to compensate for the propagation delays on the columns.

Moreover, the second signal is a switching signal of digital type determining the duration for which the activated control circuits remain on. According to one preferred embodiment, the second switching signal consists of pulses of PWM type, PWM standing for a "Pulse Width Modulation". The instant of triggering of the pulses is preferably adjusted from column to column in order to compensate for the delays on the lines.

According to one preferred embodiment of the present invention, the control circuit consists of a first transistor connecting the elementary point to the corresponding line receiving the first signal, and a second transistor a first electrode of which is connected to the gate of the first transistor, the gate of which is connected to the corresponding column receiving the second signal and the second electrode of which is connected to a reference potential.

According to one supplementary characteristic of the present invention, the elementary control circuit further includes a capacitor connected between the gate of the first transistor and the corresponding line. Likewise, the second electrode of the second transistor is connected to the preceding line. According to another characteristic of the present invention, the circuits are produced using polycrystalline silicon.

Figure 2:
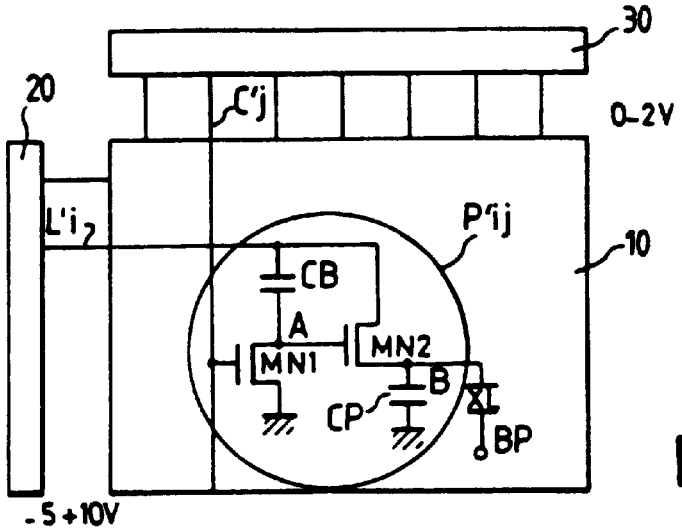
Figure 4:
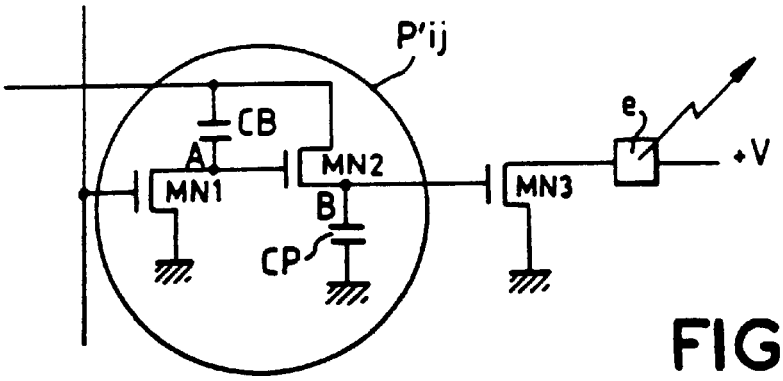
Figure 3:
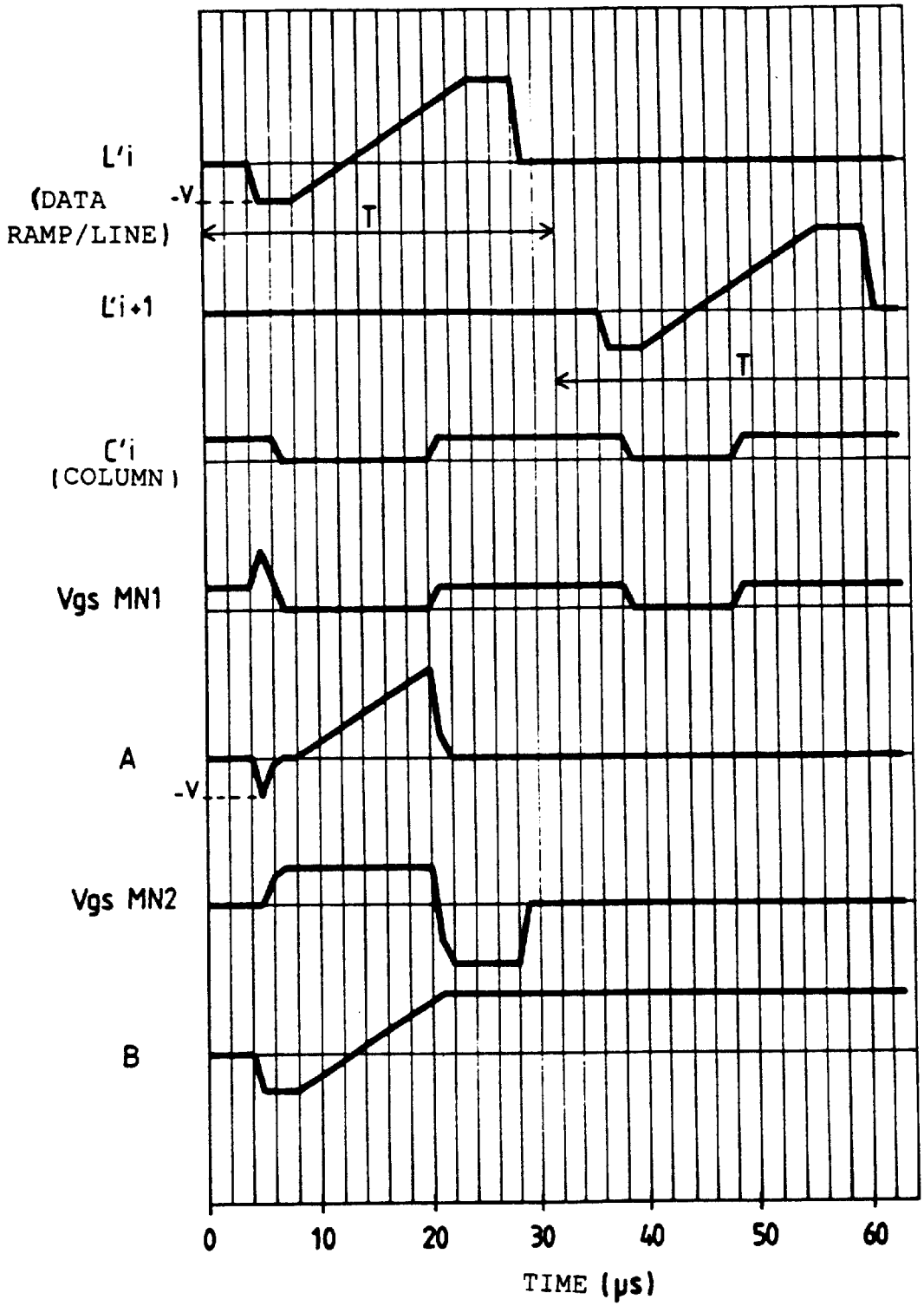

Other characteristics and advantages of the present invention will emerge on reading the description of a preferred embodiment given below, this description being given with reference to the attached drawings in which:

FIG. 1, already described, is a diagrammatic representation of a matrix control device used in the case of an active-matrix liquid crystal screen associated with line and column control circuits in accordance with the prior art;

FIG. 2 is a diagrammatic representation of a matrix control device in accordance with the present invention in the case in which the elementary point consists of a liquid crystal cell, this device being associated with line and column control circuits, FIG. 3 represents the shape of the various signals applied respectively to the lines, the columns, to point A, to point B and the gate-source voltage of the transistor MN2 in the case of the elementary control circuit of FIG. 2, and, FIG. 4 is a diagrammatic representation of a matrix control device in accordance with the present invention in the case in which the elementary point consists of an electroluminescent material, this device being associated with line and column control circuits.

In the figures, in order to simplify the description, the same elements bear the same references. Moreover, the present invention will be described by referring to a liquid crystal screen. However, it is obvious to the person skilled in the art that the invention can be applied to elementary points consisting of any circuit for storage of an electrical signal such as an electro-optical or other cell.

In FIG. 2, a matrix control device in accordance with the present invention has been represented, associated with a line control circuit 20 and a column control circuit 30; the said circuits may or may not be integrated on the same substrate as the matrix control device. In the matrix control device of FIG. 2, the elementary control circuit referenced P'ij has been modified so as to limit the electrical consumption and thus to allow production in polycrystalline silicon. More specifically, the elementary control circuit P'ij arranged in lines and columns controls an elementary point consisting, in the embodiment represented, of an electro-optical cell XL, more particularly a liquid crystal cell. A storage capacitor CP is mounted in parallel on this electro-optical cell, the said cell itself acting as a capacitor and its optical properties being modified as a function of the value of the electric field which passes through the liquid crystal.

An embodiment of an elementary control circuit P'ij will now be described, in which the principal characteristic is that of having an output signal following the input signal when it is activated by a first signal, namely that applied to the lines L'i, and the impedance of which between the input and the output becomes very high under the effect of a second signal, namely the signal applied to the columns C'j. In the case of FIG. 2, the control circuit P'ij consists essentially of a switching device MN2 preferably consisting of a thin-film transistor or TFT. One electrode of the transistor MN2 is linked to an electrode of the electro-optical cell XL, while its other electrode is linked to a line L'i. Moreover, the gate of the transistor MN2 is linked to an electrode of a second transistor MN1 the other electrode of which is connected to earth in the embodiment represented and the gate of which is connected to a column C'j. As represented in FIG. 2, a capacitor referenced CB is connected between the gate of the switching transistor MN2 and the line L'i. The connecting point between the capacitor CB and the gate of the transistor MN2 is referenced A while the connecting point between the electrode of the transistor MN2 and the electrode of the electro-optical cell XL is referenced B. The lines L'i are connected to a line control circuit 20 which supplies, on the lines, a data signal consisting of a signal which, in a first stage, makes it possible to activate all the elementary control circuits of the corresponding line by turning them on, then next to apply a voltage ramp which is sent as the output of the elementary control circuit to the cell XL. Likewise, the set of columns C'j is linked to a column control circuit 30 which, on each column, supplies a second signal consisting of a digital-type switching signal, more particularly pulses of PWM type determining the duration for which the activated control circuits P'ij remain conducting.

The operation of the control circuit represented in FIG. 2 will now be explained with reference to FIG. 3. As represented in FIG. 3, the signal applied to the lines L'i, L'i+1 consists of a negative pulse making it possible to activate all the elementary control circuits of a line followed by a ramp the amplitude of which typically varies preferably between −5 volts and +10 volts. The duration T of the signal L'i corresponds to a line time. On the line L'i+1, the same signal is applied but it is shifted by the time T as represented in FIG. 3. Moreover, a switching signal consisting of pulses of PWM type is applied to the columns C'j so as to modulate the pulses in terms of width, the signal exhibiting levels lying typically between 0 and 2 volts, in the case of an embodiment in polycrystalline silicon or in monocrystalline silicon.

When the line L'i is not addressed, the elementary control circuit consisting principally of the two transistors MN1 and MN2 operates in the following way. As represented in FIG. 2, the second electrode of the transistor MN1 is at a reference potential, namely at earth in the embodiment represented or at the potential of the preceding line which is itself at a reference voltage, since it is not addressed. When a pulse is applied on the column C'j, that is to say on the gate of the transistor MN1, the transistor MN1 is turned on and the point A, that is to say the gate of the transistor MN2, passes to the reference potential. At that moment, the gate-source voltage Vgs of the transistor MN2 is at zero, and the off current of the transistor MN2 is a minimum. It results therefrom that the electro-optical cell XL is not discharged.

When the line L'i is addressed, that is to say when it applies a signal as represented by L'i in FIG. 3, the line L'i first of all undergoes a negative voltage drop −V. The point A, because of the capacitor CB, undergoes the same instantaneous voltage drop. Since the column C'j receives a positive pulse, as represented in FIG. 3, the transistor MN1 is on and, that being so, the potential of point A is brought back to the level of the reference potential, that is to say earth or zero, in the case of the embodiment represented. The gate-source voltage Vgs of the transistor MN2 becomes positive and passes to a value corresponding to the voltage drop on the line L'i which turns the transistor MN2 on. Immediately afterwards, the voltage applied to the column C'j falls to zero, entailing the transistor MN1 passing to the off or high-impedance state. The gate-source voltage Vgs of the transistor MN2 remains constant because of the capacitor CB. When the voltage ramp is applied to the line L'i, the transistor MN2 being turned on, the voltage at point B recopies the voltage of the ramp until a further positive pulse on the column turns the transistor MN1 on, which has the effect of bringing the voltage at point A back to the reference potential. At that moment, the transistor MN2 is turned off and the voltage at point B remains constant as represented in FIG. 3.

The novel elementary control circuit above thus makes it possible to display grey levels corresponding to the duration for which the ramp is applied to point A. For use in a flat liquid-crystal screen, the voltage of each elementary cell P'ij may thus reach any value within the range of variation of the ramp supplied by the first signal. The polarity of each cell can thus be chosen independently of that of its neighbours as long as the voltage of the counter electrode is adjusted to a value close to half of the maximum voltage reached by the first signal.

The control circuit described above makes it possible to reduce consumption effectively. This is because consumption is given by $\frac{1}{2}f\,CV_2$, f being the line frequency, V the amplitude of the applied signal and C the capacitances.

The table below shows the difference in consumption between the control device of FIG. 1 and of FIG. 2 for a liquid crystal screen comprising 600 lines and 2400 columns on a diagonal of the order of 30 cm.

| COLUMNS | SIGNALS APPLIED | LINE FREQUENCY | POWER |
|---|---|---|---|
| Prior art | Analogue: +/−5 V | 30 kHz | ≈½ W |
| Invention | PWM: 0–1 V | 30 kHz | 20 mW |
| **LINES** | **SIGNALS APPLIED** | **LINE FREQUENCY** | **POWER** |
| Prior art | Digital: 40 V | 30 kHz<br>One line at a time | ≈10 mW |
| Invention | Analogue data<br>ramp: 15 V | 30 kHz<br>One line at a time | ≈2 mW |

Moreover, when polycrystalline silicon produced on glass, or monocrystalline silicon is used to produce the control device, the transistors MN2 operate with a controlled gate-source voltage, which gives a lower off current.

Another advantage of this invention is that the "column drivers" 30 have an entirely digital function, and operate at low voltage, which simplifies their design and reduces their cost.

FIG. 4 presents a variant of the invention in which the output of the elementary control circuits P'ij, identical to those represented in FIG. 3, is no longer connected to a liquid crystal element, but to the gate of a transistor MN3 the role of which is to deliver an excitation current controlled by this voltage to an electroluminescent material.

What is claimed is:

1. Matrix control device comprising:

a plurality of elementary points;

a source of first and second control signals; and a set of control circuits arranged in lines and columns for controlling states of elementary points, the state of each elementary point being a function of first and second control signals applied to a respective control circuit via the lines and columns, wherein each control circuit comprises a first input to receive the first control signal applied on a respective line, a second input which receives the second control signal applied on the respective column, and an output which is connected to a respective elementary point, wherein when a line is addressed, the first control signal applies to said first input a voltage pulse of a given value and duration followed by a voltage ramp signal during the corresponding line time on said line, the voltage ramp signal waveform varying linearly from a first voltage value to a second voltage value and over a duration greater than the voltage pulse duration, the voltage pulse operating to activate all the control circuits of the corresponding line by turning them on, so that the output of the control circuits can then follow the voltage ramp signal waveform, until the second control signal applied on the columns turns off the activated control circuits, said second control signal being a switching signal of digital type for determining the duration for which the activated control circuits remain on.

2. Device according to claim 1, wherein the voltage pulse of said first control signal comprises a negative pre-charge pulse and wherein said ramp-shaped signal of said first control signal has a magnitude at said second voltage value greater than the magnitude of said negative pre-charge pulse.

3. Device according to claim 2, wherein the triggering of the ramp-shaped signal is adjusted from line to line so as to compensate for the propagation delays on the columns.

4. Device according to claim 1, wherein the second switching signal comprises pulse-width modulated pulses.

5. Device according to claim 4, wherein the triggering of the pulses is adjusted from column to column in order to compensate for the delays on the lines.

6. Device according to claim 1, wherein each control circuit comprises first and second transistors, the first transistor having a first signal electrode forming the first input of the control circuit, and connected to a respective line, and a second signal electrode forming the output of the control circuit and connected to the respective elementary point, and the second transistor having a first signal electrode which is connected to the gate electrode of the first transistor, a second signal electrode which is connected to a reference potential, and a gate electrode forming the second input of the control circuit, connected to a respective column.

7. Device according to claim 6, wherein said device further includes a capacitor connected between the gate of the first transistor and the corresponding line.

8. Device according to claim 6, wherein the second electrode of the second transistor is connected to the preceding line.

9. Device according to claim 1, wherein the circuits are produced using transistors selected from the types polycrystalline silicon, amorphous silicon and monocrystalline silicon transistors.

10. Device according to claim 1, wherein the elementary points are electro-optical cells.

11. Device according to claim 1, wherein the output of the elementary points serves to modulate the excitation current of an electroluminescent material.

12. A matrix control device comprising:

a plurality of elementary points;

a source of first and second control signals; and a set of control circuits arranged in lines and columns for controlling states of elementary points, the state of each elementary point being a function of first and second control signals applied to a respective control circuit via the lines and columns, wherein each control circuit includes a first input, a second input, and an output, the first input connected to a respective line, the second input connected to a respective column, and the output connected to a respective elementary point, each control circuit further comprising a first transistor having a first electrode connected to the first input, and a second electrode connected to the output; and a second transistor having a gate connected to the second input, a first electrode connected to a gate of the first transistor, and a second electrode connected to a reference potential, wherein when a line is addressed, the first control signal applies a voltage pulse of a given value and duration followed by a voltage ramp signal during the corresponding line time on said line, the voltage ramp signal waveform varying linearly from a first voltage value to a second voltage value and over a duration greater than the voltage pulse duration, the voltage pulse operating to activate all the control circuits of the addressed line by turning them on, so that the output of the control circuits can then follow the voltage ramp signal waveform, until the second control signal applied on the columns turns off the activated control circuits, and wherein the second control signal is a switching signal of digital type which determines the duration for which the activated control circuit remains on.

* * * * *